United States Patent [19]

Hernandez

[11] Patent Number: 5,033,497

[45] Date of Patent: Jul. 23, 1991

[54] COMBINATION SURFBOARD-SHIPPING BAG, GROUND PAD, AND TENT

[76] Inventor: Ruben R. Hernandez, 116 Avenida Dolores, San Clemente, Calif. 92624

[21] Appl. No.: 503,538

[22] Filed: Apr. 3, 1990

[51] Int. Cl.[5] ..... E04H 15/30

[52] U.S. Cl. ..... 135/95; 206/315.1; 5/420; 441/74; 441/125; 135/116

[58] Field of Search ..... 135/95, 96, 115, 116; 206/315.1; 150/154; 5/413, 482, 417, 420; 441/74, 125, 128

[56] References Cited

U.S. PATENT DOCUMENTS

| | | | |
|---|---|---|---|
| 872,404 | 12/1907 | Burch | 2/89 X |
| 2,907,056 | 10/1959 | Kaplan | 135/96 X |
| 3,339,607 | 9/1967 | Howard | 441/74 X |
| 3,510,889 | 5/1970 | Peterson | 4/513 X |
| 3,584,323 | 6/1971 | Worley | 5/413 |
| 3,965,505 | 6/1976 | Thorowgood | 5/413 |
| 4,719,952 | 1/1988 | Geronimo | 441/74 X |

*Primary Examiner*—David A. Scherbel
*Assistant Examiner*—Lan Mai
*Attorney, Agent, or Firm*—Richard L. Gausewitz

[57] ABSTRACT

A padded body, that is adapted to be used as a ground pad and as padded tent bottom is folded over a surfboard and secured in closed position. The surfboard is thus effectively protected while being shipped and stored. A tent is adapted to be connected to the tent bottom at the beach, so as to provide a comfortable padded-floor tent for use during the day or night. During shipment of the apparatus, the tent is secured adjacent the skegs of the surfboard.

12 Claims, 2 Drawing Sheets

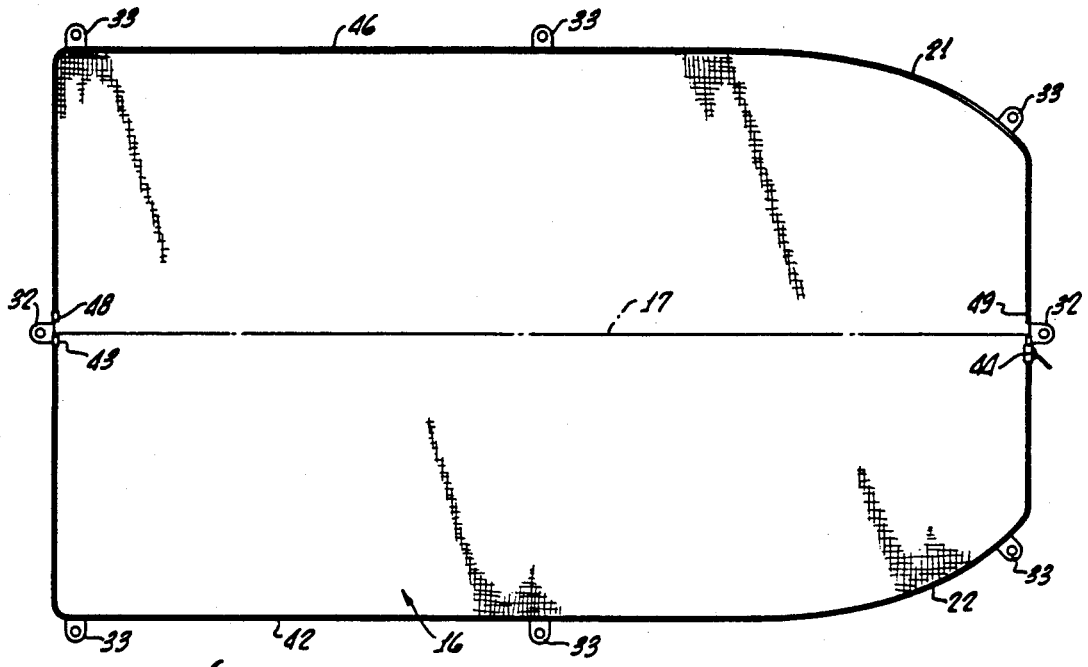
FIG. 4.
FIG. 5.
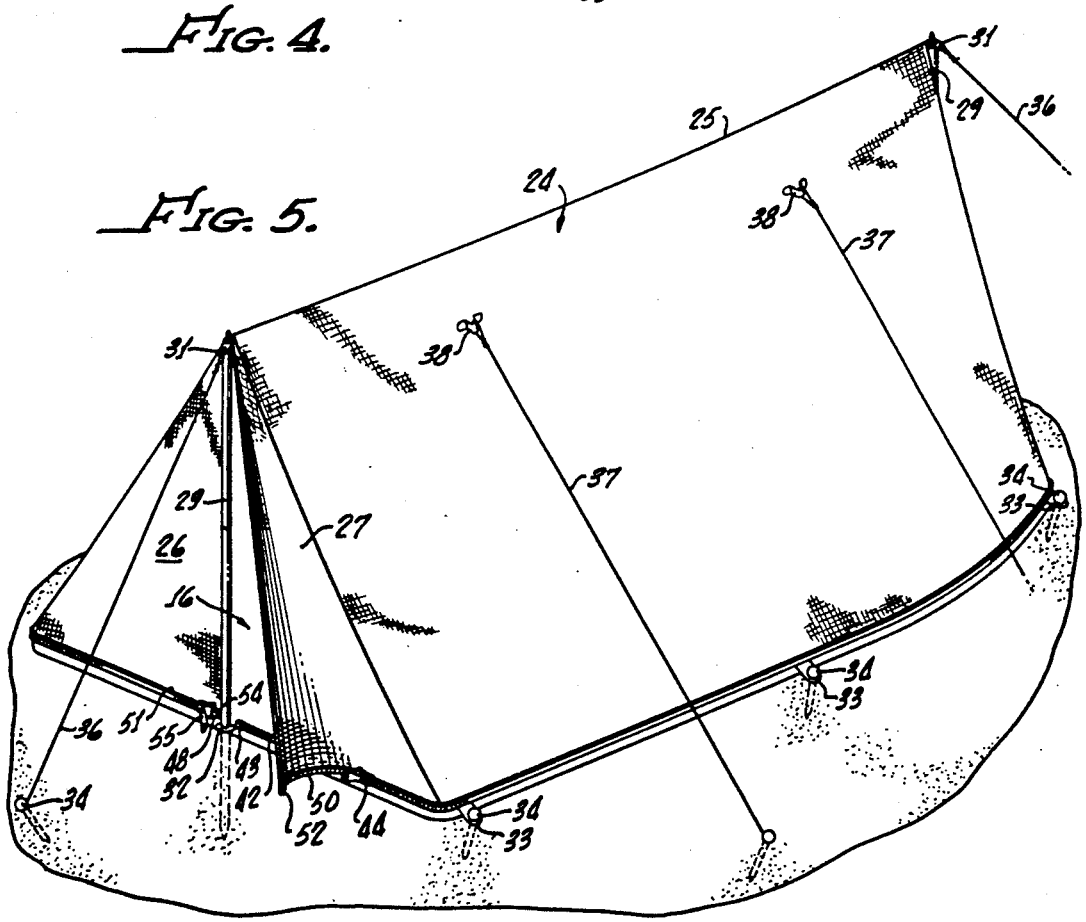

COMBINATION SURFBOARD-SHIPPING BAG, GROUND PAD, AND TENT

BACKGROUND OF THE INVENTION

Surfing contests (meets) now occur in many portions of the world. Furthermore, even in the absence of contests, surfboarding is often conducted in remote areas. Surfers have had substantial problems in shipping their boards to the location where a contest or other surfing is to occur. The boards must often be carried on airplanes, where they may be crammed in with luggage, and where the boards, including the skeg portions of the boards, may be damaged. There exists, therefore, a distinct need for an improved surfboard-shipping bag which will reduce or minimize the danger that the board will be damaged during shipping.

Once the boards and bags arrive at a beach, which may be in a remote area, there is a need for a ground pad or ground cover on which the surfer, the surfer's spouse or children may rest during portions of the long days while a contest or other surfing is going on.

There is also a need for a tent which can be employed either during the day—to guard the surfer's infants (or other children) from sun—or during the night to protect against cold and wet and save the expense of a motel (or hotel) bill even if the beach is located sufficiently close to a motel that one could be utilized.

SUMMARY OF THE INVENTION

In accordance with the present invention, there is provided an apparatus whereby a surfboard may be shipped in protected condition to a beach in a remote area. Then, while at the beach, the bag is not just a relatively useless appendage but instead performs very desirable functions as a ground pad, and as a bottom pad for a tent.

In the preferred embodiment, the bag comprises a relatively large flexible body adapted to lie substantially flat on the ground, the body being padded and having zipper means around the periphery thereof. While thus lying flat, the bag body is a ground pad or cover. A tent is provided having a lower edge the size and shape of which correspond to that of the periphery of the flat-lying bag body, there being zipper means on such lower tent edge adapted to mesh with zipper means on the bag body to provide a tent having the bag body as the padded floor thereof. A container is provided for the tent and associated hardware, being adapted to hold the tent and hardware and to be disposed adjacent the skegs of the surfboard.

Assuming that the tent and its padded floor have been fully put up and assembled at a beach, and that it is desired to leave, the tent is taken down and unzipped from the bag body. The tent is then placed in its carrying container and disposed adjacent the skegs of the surfboard. The surfboard is then disposed on one half of the bag body, to one side of the central axis thereof. The other half of the bag body is then folded over the surfboard and over the tent container, and a portion of the same zipper means that was employed to secure the tent to the bag body is employed to secure the bag body in closed condition about the surfboard and tent container. The combination apparatus is then fully ready for shipment.

BRIEF DESCRIPTION OF THE DRAWINGS

FIG. 4 is a top plan view showing the body of the bag in fully open condition; and FIG. 5 is an isometric view of the assembled tent and bag body.

DETAILED DESCRIPTION OF THE PREFERRED EMBODIMENT

Figure 3:
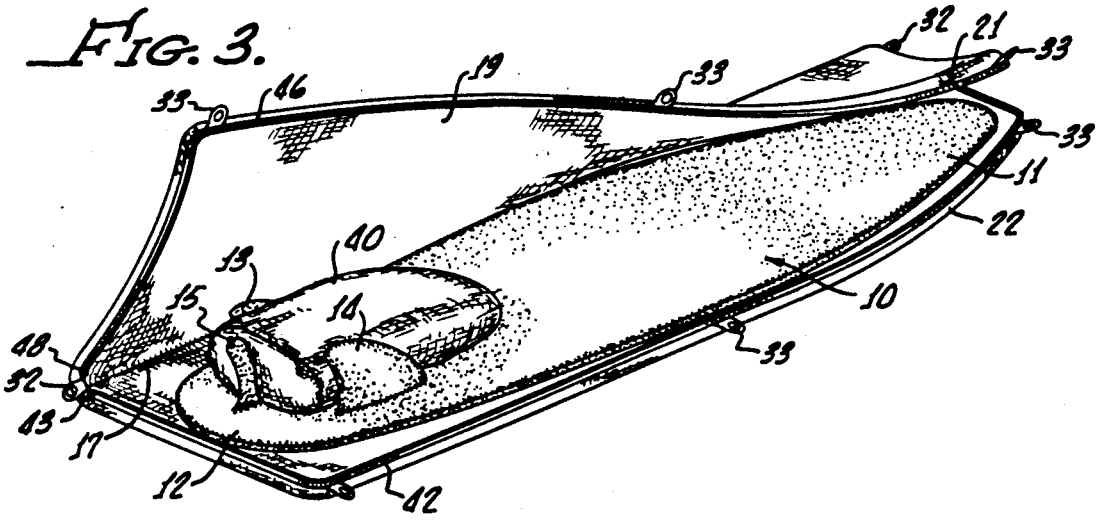
FIG. 3 is a view corresponding generally to FIG. 1 but showing the bag in partially open condition so that the surfboard and the stored tent are exposed to view.

Referring to FIG. 3, the illustrated surfboard 10, shown in inverted condition, has a tapered or convergent nose portion 11 and a rounded tail portion 12. Three skegs 13–15 are secured fixedly to the underside of the board 10. Two of the skegs, numbers 13 and 14, are spaced apart on opposite sides of the longitudinal axis of board 10. The remaining skeg, number 15, is centered between the two skegs 13,14 and located close to the extreme tail of the board.

Referring next to FIG. 4, an elongate flexible body 16 is shown as lying substantially flat on the ground. Such body is substantially longer than board 10, and is substantially wider than twice the width of board 10. The amounts by which the length and width of body 16 exceed the board length, and exceed twice the board width, are such that the body may be folded over board 10 and the body edges then secured together, following which the board will (very preferably) be a relatively snug fit in the bag thus formed from body 16.

Figure 1:
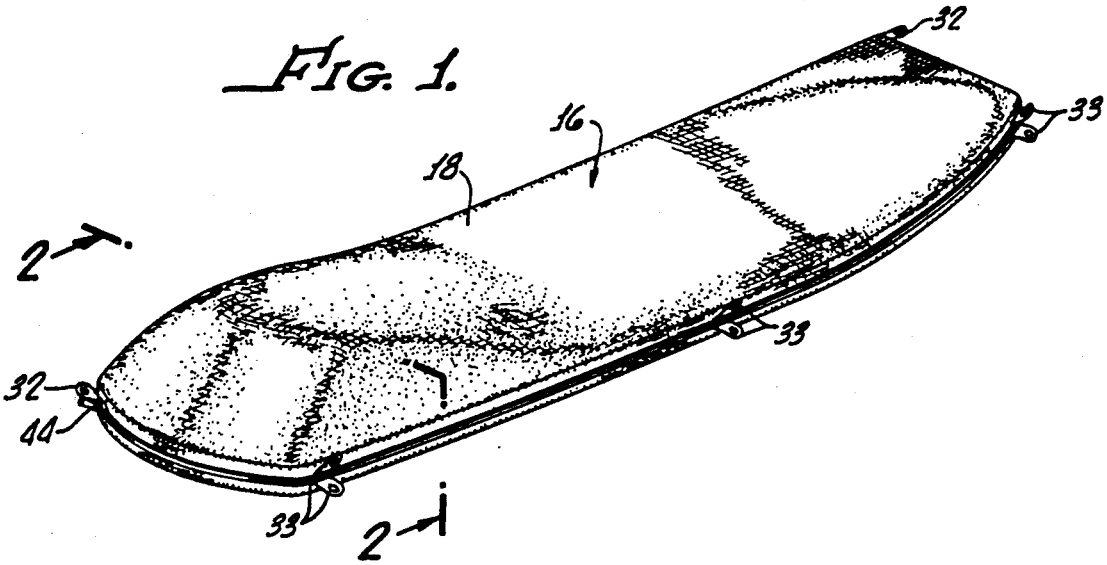
FIG. 1 is an isometric view showing the present combination in its condition wherein the surfboard and tent are contained within the closed shipping bag, being fully ready for protected shipment.
Figure 2:
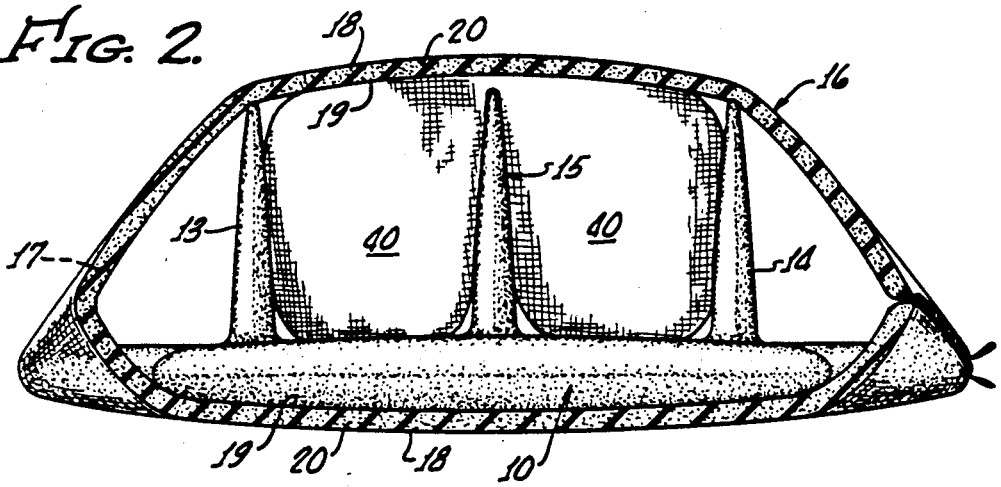
FIG. 2 is an enlarged transverse section on line 2—2 of FIG. 1.

The stated folding of body 16 is generally about the central longitudinal axis of the body, such axis being indicated at 17. Preferably, the body 16 comprises outer layers of cloth, or of flexible plastic sheeting. Between such outer layers is sandwiched a layer of resilient foam plastic, the plastic foam being sufficiently thick to provide effective protection for board 10 during shipment, and also to provide effective ground-pad action when the body 16 is open and disposed on a beach. Referring to the sectional view, FIG. 2, the indicated outer layers are designated 18,19, and the foam is designated 20. As shown in FIG. 2 there need be no crease line at the axis 17.

Again referring to FIG. 4, the portions of body 16 on opposite sides of the central axis 17 are, in the illustrated preferred embodiment, mirror images of each other. The preferred body shape is substantially rectangular, except that edge regions 21,22 shown at the right in FIG. 4 are tapered or rounded inwardly about relatively large radiuses. These edge regions 21,22 cause the surfboard-shipping bag to have a better fit relative to the tapered nose portion 11 (FIG. 3) of the board 10.

Proceeding next to a description of the tent portion of the apparatus, this is illustrated in FIG. 5. The body 16, exactly as shown in FIG. 4 (except for zipper slider position), is present beneath the illustrated tent and forms the padded floor for such tent—being secured thereto as described below. The bottom edge of the tent corresponds in size and shape to the periphery of the opened bag or body 16.

The tent has the general number 24, and is illustrated as being a wedge-shaped tent known as a pup tent. Tent 24 has a peak or crown 25 that is stretched tight directly above the axis 17 (FIG. 4) of body 16. Such peak extends for the full length of the body 16. Door means are provided at at least one end of the tent, and preferably at both ends thereof, the door means being secured by suitable zippers (not shown). Very preferably, the doors are such that both may be opened simultaneously so as to permit through-flow of sea breezes, especially during the day when the sun is out. Two door flaps 26,27 are shown at the left in FIG. 5, and are secured in closed position by a vertical zipper, not shown. Two additional flaps are provided at the right end of the tent but are not illustrated. These flaps, and the associated vertical zipper, correspond to the flap elements at the left tent end. However, at the right end of the tent there are horizontal zippers spaced slightly above the zippers that connect the tent to body 16, so that the tent flaps may be operated independently of the zippers (described below) that connect tent 24 to body 16.

To maintain the tent 24 in taut, deployed condition, tent poles 29 are extended vertically upwardly from body 16 at opposite ends of axis 17. The tent poles extend, at each end of the tent, through an eyelet 31 at an end of peak or crown 25, and through an eyelet in an ear 32 that is secured to body 16 at an end thereof adjacent the axis 17. The tent poles 29 are preferably segmented or telescoping, but need not be since they may be shipped in full-length condition in parallel relationship to the board 10 within the shipping bag. Ears 33, each having an eyelet therein, are secured to the edge of body 16 at spaced points therearound, to receive tent stakes 34 through the eyelets in the ears 33.

Additional tent stakes 34 are spaced outwardly from body 16. Two of such additional stakes 34, opposite the ends of the tent, are secured to tent lines 36 that connect to the upper ends of tent poles 29. Other tent stakes connect through lines 37 to loops 38 that are sewn to the sides of the tent relatively near the crown 25 thereof. It is to be understood that the tent-supporting means at the right end of FIG. 5 are the mirror image of the tent-supporting means shown at the left end thereof.

The tent 24 is formed of light weight, sun and rain-resistant fabric, being preferably a synthetic resin fabric that can be compressed into a small space. A storage container 40 (FIGS. 2 and 3) is provided to contain the tent and the associated tent stakes and lines.

There will next be described the means for securing the bottom edge of tent 24 to the peripheral edge of body 16, and also for securing the body 16 in clamshell relationship around the surfboard 10 and the stored tent.

Referring to FIG. 4, a zipper track 42 (comprising a multiplicity of teeth) is provided about the periphery of that half of body 16 which is below axis 17 as viewed in FIG. 4. Such track 42 extends from a first stop 43 located relatively near axis 17 at the left end of body 16, to a second stop located at the right end of body 16 and near axis 17. A slider 44 is mounted on such track 42 for movement between the stops at opposite ends of the track, the mouth of the slider being directed away from axis 17 when the slider 44 is in the position illustrated in FIG. 4.

A second zipper track 46 is mounted around that portion of body 16 shown in FIG. 4 above the axis 17 in viewed in that figure. Track 46 extends from a stop 48 at the left end of FIG. 4 and near axis 17, to an insertion member 49 disclosed at the right end of FIG. 4 somewhat above axis 17 as viewed in that figure. Insertion member 49 is a conventional elongate track end and is adapted to be inserted into the mouth of slider 44 when it is desired to operate the zipper means so as to close the body 16 around the surfboard 10 to thus form the surfboard-shipping bag. It is to be understood that the insertion member 49 is spaced sufficiently far from the stop at the right end of track 42 (FIG. 4) that the indicated insertion of member 49 into slider 44 may readily take place.

Zipper tracks 50 and 51 are provided around the lower edge of tent 24 directly above zipper tracks 42 and 46, respectively. Track 50 has a stop 52 at its left end (FIG. 5), and has at its right end an elongate insertion member (not shown) adapted to be inserted into slider 44 when the latter is in the position shown in FIG. 4.

Track 51, which extends around the tent bottom above track 46, has a stop 54 at the left end thereof as viewed in FIG. 5. There is also as a stop (not shown) directly above the insertion member 49. A slider 55 is mounted on track 51 and has its mouth facing towards stop 54 when the slider 55 is in the position shown in FIG. 5.

Tracks 42 and 50 correspond to each other and are adapted to be closed and opened by slider 44. Tracks 46 and 51 correspond to each other, and are adapted to be opened and closed by slider 55. Preferably, all tracks and sliders are identical to each other.

OPERATION

To provide a combination surfboard and surfboard-shipping bag, the body 16 is first spread out on the ground as shown in FIG. 4. Then, surfboard 10 is disposed in inverted condition on the side of body 16 that is below axis 17 (as viewed in FIG. 4), and the side of body 16 above the axis is bent or clamshelled around the surfboard as shown in FIG. 3. The tent storage container 40 is filled with the tent 24 and disposed adjacent skegs 13,14 as shown in FIG. 3. The insertion member 49 (FIG. 4) at the end of track 46 is then inserted into the mouth of slider 44 (FIG. 4), and the slider 44 is moved around half the periphery of the body 16 to effectively secure track 46 to track 42.

The combination apparatus is then shipped, as by airplane, to a remote area and then transported to a beach.

At the beach, slider 44 is moved in the reverse direction so that the body 16 fully opens to the position shown in FIG. 4. Surfboard 10 is then removed, and tent 24 is removed from tent storage container 40.

With the slider 44 in the position shown in FIG. 4, the insertion member (not shown) at the end of track 50 on tent 24 is inserted into the mouth of slider 44. Slider 44 is then moved around half the periphery of body 16 to cause the tracks 42 and 50 to mesh with each other and secure the tent to the body 16. Thereafter, or previously, slider 55 on tent 24 is caused to be at the right end of the tent, and to be penetrated by the insertion member 49 shown at the right in FIG. 4, following which the slider 55 is moved about half the periphery of the tent and body 16 to effectively secure the other half of the tent to the other half of the body. Slider 55 then reaches the position shown at the left in FIG. 5.

The poles 29, tent lines 36,37, etc., are then employed to set up the tent 24 and result in the combination construction shown in FIG. 5.

When it is desired to strike the tent, the process is reversed. Thus, the lines 36,37, tent poles 29, etc., are taken down and disposed in the tent storage container 40. The sliders 44 and 55 are then moved in directions to disconnect tent 24 from body 16. The tent is then placed in the storage container 40 which is then located adjacent the skegs 13–15. Thereafter, the surfboard-shipping bag is mounted around the surfboard as described above.

ADDENDA

The cloth 18,19 is preferably nylon ripstop fabric that is laminated to the foam 20. The fabric of tent 24 is preferably also nylon ripstop.

The body 16 may be made sufficiently large that it may be closed over two surfboards, the surfboards being disposed in back-to-back relationship to each other, or else with the skegs meshed. The surfboards may first be secured together by velcro straps, with a suitable pad therebetween to prevent rubbing.

The foam plastic is preferably polyurethane.

The bag 40 for the tent is preferably formed of nylon ripstop having a foam (polyurethane) liner and suitable dividers. Preferably, the tent poles 29 are collapsible and go within the bag 40.

The best mode contemplated by the inventor at the time of filing of the present application includes a relatively large container 40 for the tent, such container having padded (by foam) ripstop walls, the bag being mounted between the body 16 and the edges of the skegs or fins 13–15. Thus, the tent material and the foam cooperate to protect the skegs 13–15, in combination with the material 18–20 of body 16. If desired, the container 40 may be thus secured to the board by velcro straps, prior to mounting within the body 16. Then, the tent container 40 and its tent-cloth contents being between the outer edges of skegs 13–15 and the region of body 16 nearest the skeg edges, there are several layers of foam plastic and cloth and tent bag material protecting the skegs 13–15 against breakage. Thus, the skegs are protected by body 16, by the tent material, and by container 40—all of these elements having portions located outwardly of the skeg edges.

It is to be understood that the pup tent 24 is but one type of tent that may be employed in combination with the body 16. It is also contemplated that there be other types of tents, for example self-contained tents that do not require lines (such as 26,37) but instead have flexible bent support elements. In other words, types of tents that are self-supporting and do not require spaced-out tent stakes may also be employed in combination with the body 16. All such tents have the size relationship to body 16 that the bottom tent edges may be secured to the body as by the zipper means described in detail above.

The foregoing detailed description is to be clearly understood as given by way of illustration and example only, the spirit and scope of this invention being limited solely by the appended claims.

What is claimed is:

1. In combination:

(a) a surfboard, and (b) a surfboard-shipping bag, said surfboard-shipping bag comprising an elongate flexible body adapted to lie substantially flat on the ground, said body when thus lying on the ground having a length longer than that of said surfboard and a width wider than twice the width of said surfboard, said length of s id body being sufficiently short, and said width thereof sufficiently narrow, that when said body is return-bent about the longitudinal central axis thereof, while said surfboard is lying on one half of said body to one side of said axis, said surfboard is sandwiched between the halves of said body that are on opposite sides of said axis and ends of said body protrude beyond said surfboard but not so far therebeyond that said surfboard will not be a relatively snug fit in said bag when said edges are secured to each other, and (c) means to secure the edges of the half of said body on one side of said axis, to the opposed edges of said body on the other side of said axis, whereby said surfboard is secured in a bag formed by said body and said securing means, and whereby said body may be opened and laid substantially flat on the ground so as to serve as a large area ground cover while said surfboard is being used at a beach.

2. The invention as claimed in claim 1, in which said body is padded whereby to protect said surfboard while it is disposed in said bag, and whereby to provide comfort to a person lying on said body while it is in opened condition on the ground, said body then serving as a ground pad.

3. The invention as claimed in claim 2, in which said body comprises two layers of surface material having resilient foam padding sandwiched therebetween.

4. The invention as claimed in claim 1, in which said surfboard has skegs at one side thereof on one end thereof, and in which said body is sufficiently large to fit around said skegs when said securing means is in secured condition.

5. The invention as claimed in claim 1, in which said body has two sides that are symmetrical about said axis.

6. The invention as claimed in claim 1, in which said securing means comprises zipper means.

7. A combination surfboard-shipping bag, ground cover, and tent, which comprises:

(a) an elongate flexible body adapted to lie substantially flat on the ground, said body when thus lying on the ground having a length longer than that of said surfboard with which said body is to be associated, and having a width wider than twice the width of said surfboard, (b) a tent sized at the bottom thereof to mate with the peripheral edge of said body when said body is lying substantially flat on the ground, and (c) fastener means on said body at the peripheral edge thereof, and on said tent at said bottom thereof, said fastener means being such that said body may be closed by said fastener means in clamshell manner around said surfboard so as to provide a closed surfboard-shipping bag, said fastener means also being such that the bottom edge of said tent may be secured by said fastener means to the peripheral edge of said body to thus provide a tent having said body as the floor thereof.

8. The invention as claimed in claim 7, in which a storage container is provided for said tent, in which said surfboard with which said combination element is to be associated has skegs on one side thereof at one end thereof, and in which said storage container is disposed adjacent said skegs.

9. The invention as claimed in claim 7, in which a plurality of outwardly-extending ears are provided around the peripheral edge of said body, each of said ears having an opening thereon for a stake.

10. The invention as claimed in claim 7, in which said body is padded to thus provide protection for said surfboard and to provide a ground-pad effect when said body is lying in open condition on the ground with a person positioned thereon.

11. The invention as claimed in claim 7, in which said fastener means comprises zipper means, there being zipper track means provided on said peripheral edge of said body substantially the entire way around said body while said body is lying in open condition on the ground, in which said tent has zipper track means around said lower edge thereof, in which said zipper track means on said body and tent correspond to each other, so that each can use the same zipper slider, and in which zipper slider means are provided to cooperate with said track means on said tent and body to selectively close said bag or connect said body to said tent so that said body forms the floor of said tent.

12. The invention as claimed in claim 11, in which one of said sliders is provided on said tent and the other of said sliders is provided on said body.

* * * * *